US005953830A

United States Patent [19]

Jannach

[11] Patent Number: 5,953,830

[45] Date of Patent: Sep. 21, 1999

[54] APPARATUS FOR DRYING CLOTHING, JACKETS OR THE LIKE

[75] Inventor: Helmut Jannach, Andritzer Reichsstr. 66, A-8042 Graz, Austria

[73] Assignee: Helmut Jannach, Graz, Austria

[21] Appl. No.: 08/894,804

[22] PCT Filed: Mar. 1, 1996

[86] PCT No.: PCT/AT96/00037

§ 371 Date: Oct. 27, 1997

§ 102(e) Date: Oct. 27, 1997

[87] PCT Pub. No.: WO96/27043

PCT Pub. Date: Sep. 6, 1996

[30] Foreign Application Priority Data

Mar. 2, 1995 [AT] Austria ..... 111/95

[51] Int. Cl.[6] ..... F26B 25/00

[52] U.S. Cl. ..... 34/104; 34/239

[58] Field of Search ..... 34/104, 105, 106, 34/90, 239

[56] References Cited

U.S. PATENT DOCUMENTS 4,094,076 6/1978 Baslow ..... 34/90

5,222,308 6/1993 Barker et al. ..... 34/104

FOREIGN PATENT DOCUMENTS 380433 8/1990 European Pat. Off. ..... 34/104

468212A1 1/1992 European Pat. Off. .

1375666 12/1961 France .

597822 4/1978 Switzerland .

600881 6/1978 Switzerland .

WO96/27043 9/1996 WIPO .

*Primary Examiner*—Henry Bennett

*Assistant Examiner*—Pamela A. Wilson

*Attorney, Agent, or Firm*—Foley & Lardner

[57] ABSTRACT

The invention pertains to an apparatus for drying protective clothing, jackets or the like, in which the clothing is hung up over carrying elements which are coathangerlike in shape, where one or more carrying elements 2, 2', 2" which are formed by tubes and are equipped with exit apertures 4 for air used for drying are arranged on a distributor tube 1 for the air used for drying, the interior of said elements being in communication with the interior of the distributor tube 1, and additional exit apertures 5 for the air used for drying being disposed on the distributor tube 1 adjacent to the carrying elements which are coathangerlike in shape.

5 Claims, 2 Drawing Sheets

APPARATUS FOR DRYING CLOTHING, JACKETS OR THE LIKE

Figure 1:
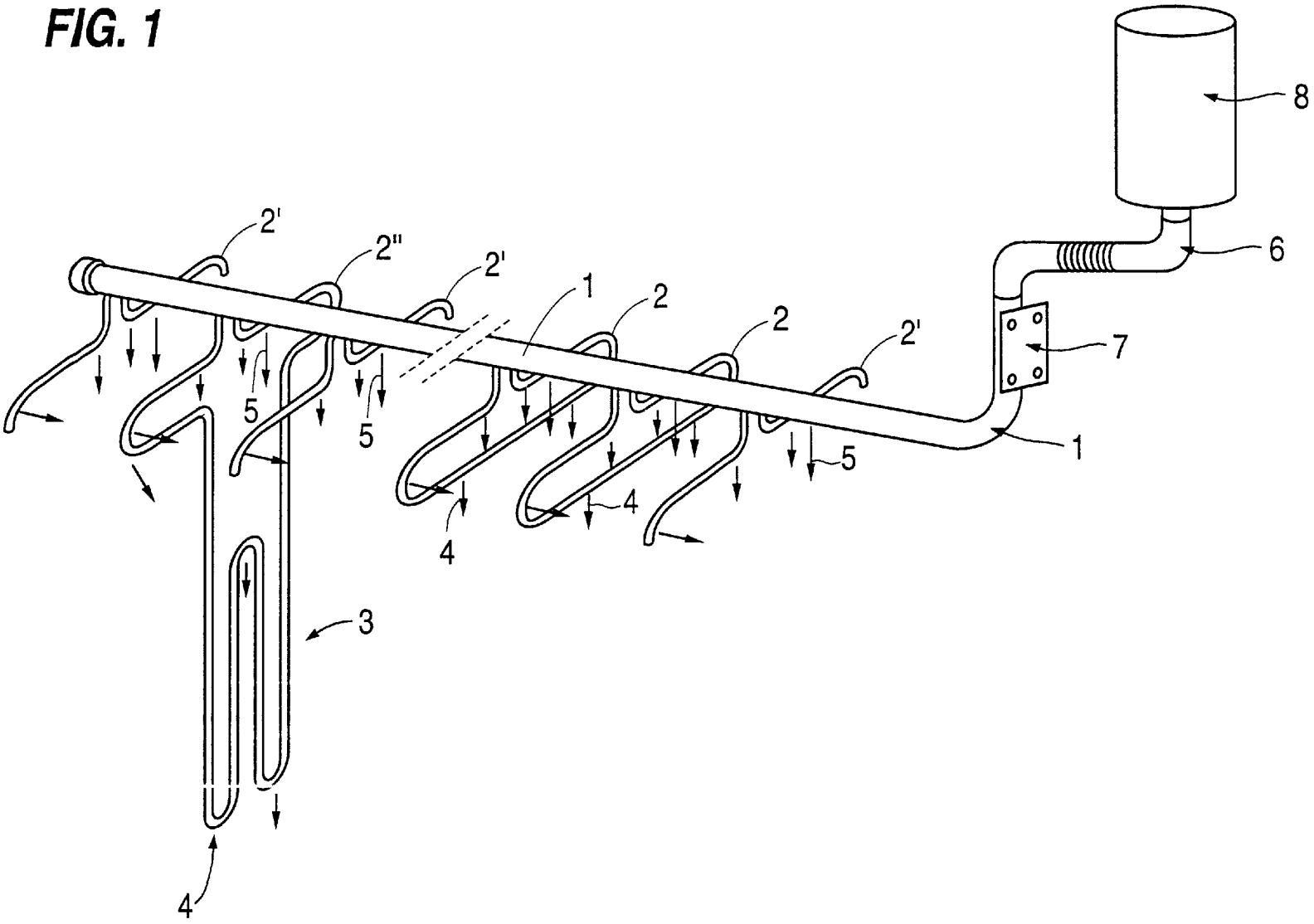

The invention relates to an apparatus for drying protective clothing, jackets or the like in which the clothing and/or the jackets are hung up over carrying elements which have a general coathanger shape.

In the case of known developments of this kind, the carrying elements are formed by coathangers fabricated from solid material which are arranged in a box to which hot air can be applied. These arrangements are very expensive and also have the disadvantage that the drying of the clothing on the inside is deficient insofar as the moist air is unable to escape.

The object on which the invention is based is to create an apparatus of the type specified at the outset in which the protective clothing, inside as well, can be dried rapidly and effectively.

In accordance with the invention this object is achieved in that one or more carrying elements, which are formed by tubes and which are equipped with exit apertures for air used for drying, are arranged on a distributor tube for the air used for drying, the interior of said elements being in communication with the interior of the distributor tube, and additional exit apertures for the air used for drying being disposed on the distributor tube adjacent to the carrying elements which are coathangerlike in shape. The result of this is that air used for drying is blown by way of the carrying elements, coathangerlike in shape, into the inside of the jackets and protective clothing, with the exit apertures provided at the ends or at the outer bends blowing the air used for drying into the sleeve region as well. On the outsides the protective clothing and/or protective jackets are blown dry by the additional exit apertures.

Advantageously, some or all of the carrying elements, coathangerlike in shape, can be equipped with tubular extensions, themselves equipped with exit apertures for the air used for drying, which extensions can be introduced into the leg or foot region of protective clothing. This ensures that, when entire suits of protective clothing are being dried, the foot regions as well are dried appropriately. In a further advantageous embodiment it is possible to install in the distributor tube, prior to that one of the carrying elements which is foremost in the flow direction of the air used for drying, a junction port which has a shutoff element. This enables cleaners and/or disinfectants to be added to the air used for drying. In this context it is possible to insert a separate shutoff element into the distributor tube prior to the junction port in the flow direction of the air used for drying, which element also permits the use of a cleaner and/or disinfectant, for example washing water, on its own.

The drawing depicts two exemplary embodiments of the subject-matter of the invention, showing different types of carrying elements.

FIG. 1 shows a diagram of a first embodiment.

Figure 2:
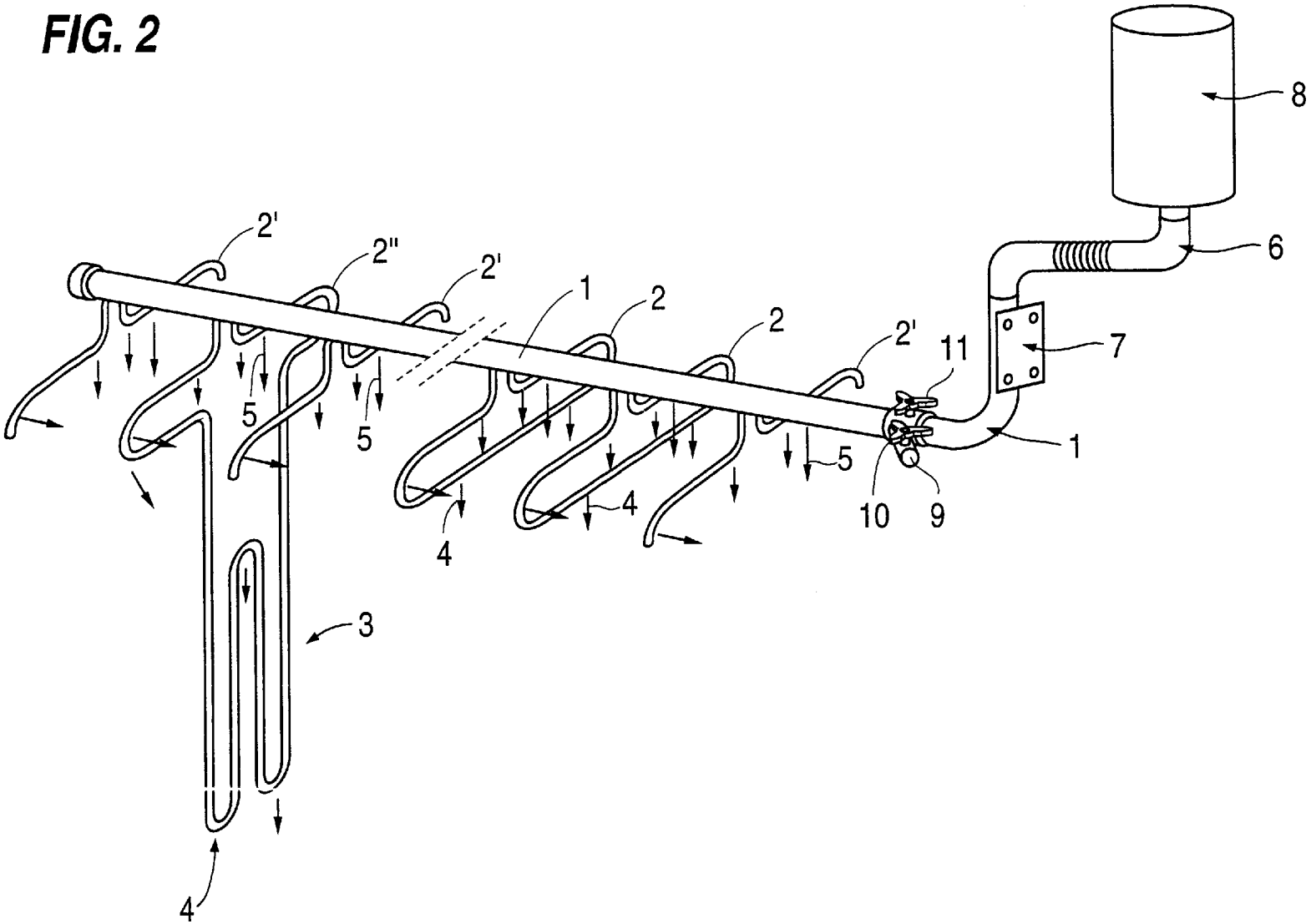

FIG. 2 reproduces, in an analogous depiction, a second variant having additional connection ports.

A distribution tube 1 is provided with carrying elements 2, 2', 2" which are equipped with exit apertures for air used for drying. These exit apertures are indicated by the arrows 4. Between the individual carrying elements 2, 2', 2" there are additional air exit apertures on the distribution tube 1 which are indicated by the arrows 5.

As can be seen, the carrying elements 2, 2', 2" are different in shape, this drawing only being by way of example. Thus it is possible, in general and if desired, to provide carrying elements 2 or carrying elements 2' open at the bottom or else carrying elements 2" provided with extensions 3 for introduction into a leg region and/or foot region of clothing. The carrying elements 2 are usually used for clothing which is relatively high in weight. The carrying elements 2' are intended for lighter jackets, and the ends can be open for direct blowing into the sleeve.

The carrying elements 2" with extensions 3 serve to make it possible to blast entire suits of protective clothing from the inside with air used for drying.

The distribution tube 1 is fed by way of a distributor line 6 and can be screwed firmly, for example to the wall or to the walls of the box, via a support element 7. The air used for drying is blown into the distributor tube by way of a fan 8 which is connected to the line 6.

In the variant embodiment of FIG. 2 a junction port 9 is inserted into the distributor tube 1, prior to the first of the carrying elements 2, 2', 2" in the flow direction of the air used for drying, which port is equipped with a shutoff element 10 and can be connected to a feedline for a cleaner and/or disinfectant. A further shutoff element 11 is provided upstream of the junction port 9. With this embodiment it is possible to apply either air used for drying on its own, air used for drying to which cleaner and/or disinfectant has been added, or else just cleaner and/or disinfectant, in order to clean soiled or otherwise contaminated clothing prior to or during the drying operation.

I claim:

1. An apparatus for drying clothing, comprising:

an air source;

tubular carrying elements for carrying clothing, said carrying elements being formed into a general coathanger shape and having exit apertures for air used for drying clothing on said carrying elements; and a distributor tube connected to said air source, said carrying elements being positioned along, and extending down from, said distributor tube so that an interior of said distributor tube is in communication with an interior of said carrying elements to distribute air to said interior of said carrying elements, said distributor tube having additional exit apertures between adjacent ones of said carrying elements.

2. The apparatus according to claim 1, wherein at least one of said carrying elements has a tubular extension extending downward therefrom, said tubular extension having exit apertures and being formed for introduction into at least one of a leg region and foot region of clothing.

3. The apparatus according to claim 1, further comprising a junction port installed in said distributor tube at a position between said air source and a first of said carrying elements positioned closest to said air source, said junction port having a shutoff element.

4. The apparatus according to claim 3, further comprising a further shutoff element installed in said distributor tube between said junction port and said air source.

5. The apparatus according to claim 2, further comprising a junction port installed in said distributor tube at a position between said air source and a first of said carrying elements positioned closest to said air source, said junction port having a shutoff element.

* * * * *